US006669156B2

(12) United States Patent
East et al.

(10) Patent No.: US 6,669,156 B2
(45) Date of Patent: Dec. 30, 2003

(54) REVERSIBLE GARAGE DOOR TRACK BRACKET

(75) Inventors: A. Anthony East, East Bend, NC (US); Ron Sutcliffe, Hannibal, NY (US)

(73) Assignee: Amarr Garage Doors, Lawrence, KS (US)

( * ) Notice: Subject to any disclaimer, the term of this patent is extended or adjusted under 35 U.S.C. 154(b) by 49 days.

(21) Appl. No.: 10/004,657

(22) Filed: Dec. 4, 2001

(65) Prior Publication Data

US 2003/0102417 A1 Jun. 5, 2003

(51) Int. Cl.[7] ..... A47F 5/00

(52) U.S. Cl. ..... 248/300; 248/558; 16/94 R; 160/201

(58) Field of Search ..... 248/300, 558, 248/544, 200, 207, 236, 238, 222.41, 224.8, 223.3, 223.4, 235, 247, 250, 225.11; 16/94 R; 160/201, DIG. 1

(56) References Cited

U.S. PATENT DOCUMENTS 1,722,529 A * 7/1929 Macdonald ..... 248/222.41
2,246,457 A * 6/1941 Schultz ..... 403/217
4,251,969 A * 2/1981 Bains ..... 52/584.1
4,460,147 A * 7/1984 Macbain ..... 248/542
4,549,712 A * 10/1985 Simon et al. ..... 248/224.8
4,566,211 A * 1/1986 Gustafson et al. ..... 40/605
5,240,216 A 8/1993 Lin et al.
5,284,199 A * 2/1994 Finch et al. ..... 160/133
5,408,724 A 4/1995 Mullet et al.
5,533,561 A * 7/1996 Forehand, IV ..... 160/188
5,568,672 A 10/1996 Mullet et al.
5,718,533 A 2/1998 Mullet et al.
6,131,361 A * 10/2000 Murphy ..... 52/712
6,295,763 B1 * 10/2001 Serba ..... 49/468
6,527,035 B2 * 3/2003 Hoofard et al. ..... 160/201

* cited by examiner

*Primary Examiner*—Anita King
(74) *Attorney, Agent, or Firm*—Hovey Williams LLP

(57) ABSTRACT

A reversible garage door track bracket (10) comprises a short flange (16) and a perpendicularly oriented long flange (18). The short flange (16) includes a slot (40) which has a wide portion (42) for receiving a jamb bolt (24), a narrow portion (44) for receiving a track bolt (26), and a plurality of holes (52) each for receiving one of a plurality of rivets (22). The long flange (18) is identical to the short flange (16), except in length. In use, an installer chooses which flange (16, 18) to secure to the track (12), by examining a garage door's thickness. The installer secures the bracket (10) to the track (12) using either the track bolt (26) or the plurality of rivets (22). If the installer desires a different mounting distance (90), the installer can simply remove the two bolts (24,26), reverse the bracket (10), and reinstall the two bolts (24,26).

10 Claims, 3 Drawing Sheets

REVERSIBLE GARAGE DOOR TRACK BRACKET

BACKGROUND OF THE INVENTION

1. Field of the Invention

The present invention relates to garage doors and garage door track brackets. More particularly, the present invention relates to a reversible garage door track bracket that can be used to mount a garage door track a wide range of distances from a door jamb.

2. Description of Prior Art

There are many brackets and methods for securing a garage door track to a door jamb. This is because garage doors are available in a variety of thicknesses due to a number of design issues including insulation, stiffness, and aesthetic appeal.

The thickness of a garage door must be considered when mounting the door. The door must be mounted with a specific mounting distance from the jamb whereby the distance is defined by the thickness. A front surface of the door moves in close proximity to the jamb, while a rear surface has a roller mounted thereto. The front surface must rest substantially flush with the jamb, since the door is expected to substantially seal an opening defined by the jamb when the door is in a closed position. The door must also move freely between the closed position and an open position. The roller, mounted to the rear surface, rides within the track. Therefore, the distance the track is mounted from the jamb is critical. If the track is mounted too far from the jamb, there will be a gap between the door and the jamb when the door is closed. If the track is mounted too close to the jamb, the door will not close or move properly.

Garage door track brackets typically have a jamb flange and a perpendicularly extending track flange. The jamb flange is typically secured to the jamb with a large jamb bolt. The track flange is typically secured to the track with a small track bolt. Typically, both the jamb flange and the track flange include a hole or a slot for receiving the jamb bolt or track bolt therein, respectively.

Currently, there are three types of brackets available to accommodate the variety of garage door thicknesses. A first type is a simple bracket designed to fit one specific size of door with a predefined mounting distance. A number of these brackets, each constructed with a different predefined mounting distance, are needed to accommodate the variety of garage door thicknesses. An installer is therefore required to stock many of these brackets so as to accomodate all possible door thicknesses. Additionally, the installer must insure that a variety of the brackets are delivered to each job site and must collect the excess brackets once the door is installed. Managing a large inventory of the brackets is both labor and capital intensive.

A second type is a multiple distance bracket. This bracket includes multiple holes or slots in the track flange to accommodate many standard door thicknesses. Unfortunately, there are limits to the number of different thicknesses that can be accommodated. Therefore, the multiple distance bracket is not suitable for a nonstandard door thickness or a special mounting requirement.

A third type is a limited slot bracket. This bracket includes a slot on the track flange to allow for a limited degree of accommodation for different door thicknesses. In order to accommodate different door thicknesses, the track flange is substantially longer than even the largest distance it is designed to accommodate. In the case where the distance between the jamb and the track is relatively small, the track flange extends well beyond the track. Such a protrusion is very undesirable, because a person or an object may inadvertently strike it, causing possible bodily injury or damage to clothing and other objects.

Accordingly, there is a need for an improved garage door track bracket that overcomes the limitations of the prior art.

SUMMARY OF THE INVENTION

The reversible garage door track bracket of the present invention overcomes the above-identified problems and provides a distinct advance in the art of garage door track brackets. More particularly the present invention provides a reversible garage door track bracket that can be used to mount a track a wide range of distances from a door jamb without necessitating use of a variety of differently sized brackets and without resulting in undesirable protrusions of the bracket after it has been mounted.

The preferred reversible garage door track bracket broadly comprises a short flange and a long flange oriented perpendicular to one another. The short flange includes a short slot and the long flange similarly includes a long slot. Each slot comprises two distinct slot widths each accommodating two differently sized bolts. Each flange also includes a plurality of holes through which a plurality of rivets can be secured.

For relatively thick garage doors, the short flange is secured to the jamb, with a jamb bolt driven through a wide portion of the short slot, and the long flange is secured to the track, with a track bolt driven through a slim portion of the long slot. Alternatively, the track can be supported by rivets riveted through any of the holes in the long flange. The elongation of the slots and the dispersion of the holes allow for a great degree of flexibility in mounting the bracket to the jamb and mounting the track to the bracket.

For relatively thin garage doors, an even greater degree of flexibility is achieved by reversing the bracket such that the long flange is secured to the jamb and the short flange is secured to the track. The versatility of the bracket simplifies the installation of a garage door, by replacing many prior art brackets of varied sizes. Additionally, undesirable protrusions can be avoided.

BRIEF DESCRIPTION OF THE DRAWINGS

A preferred embodiment of the present invention is described in detail below with reference to the attached drawing figures, wherein.

DETAILED DESCRIPTION OF A PREFERRED EMBODIMENT

Figure 1:
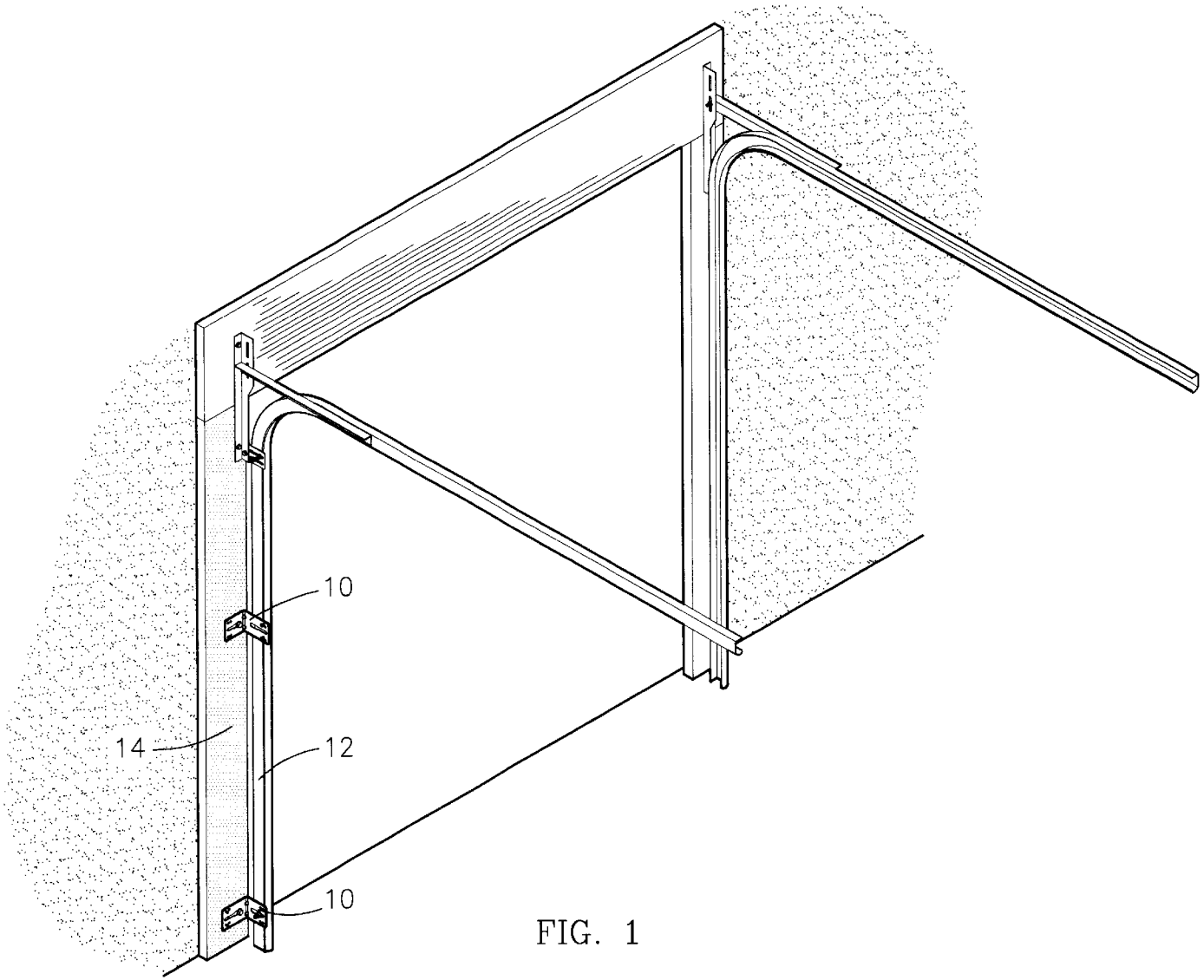
FIG. 1 is a perspective view of several reversible garage door track brackets constructed in accordance with a preferred embodiment of the present invention and shown attached to a conventional garage door track and jamb.
Figure 2:
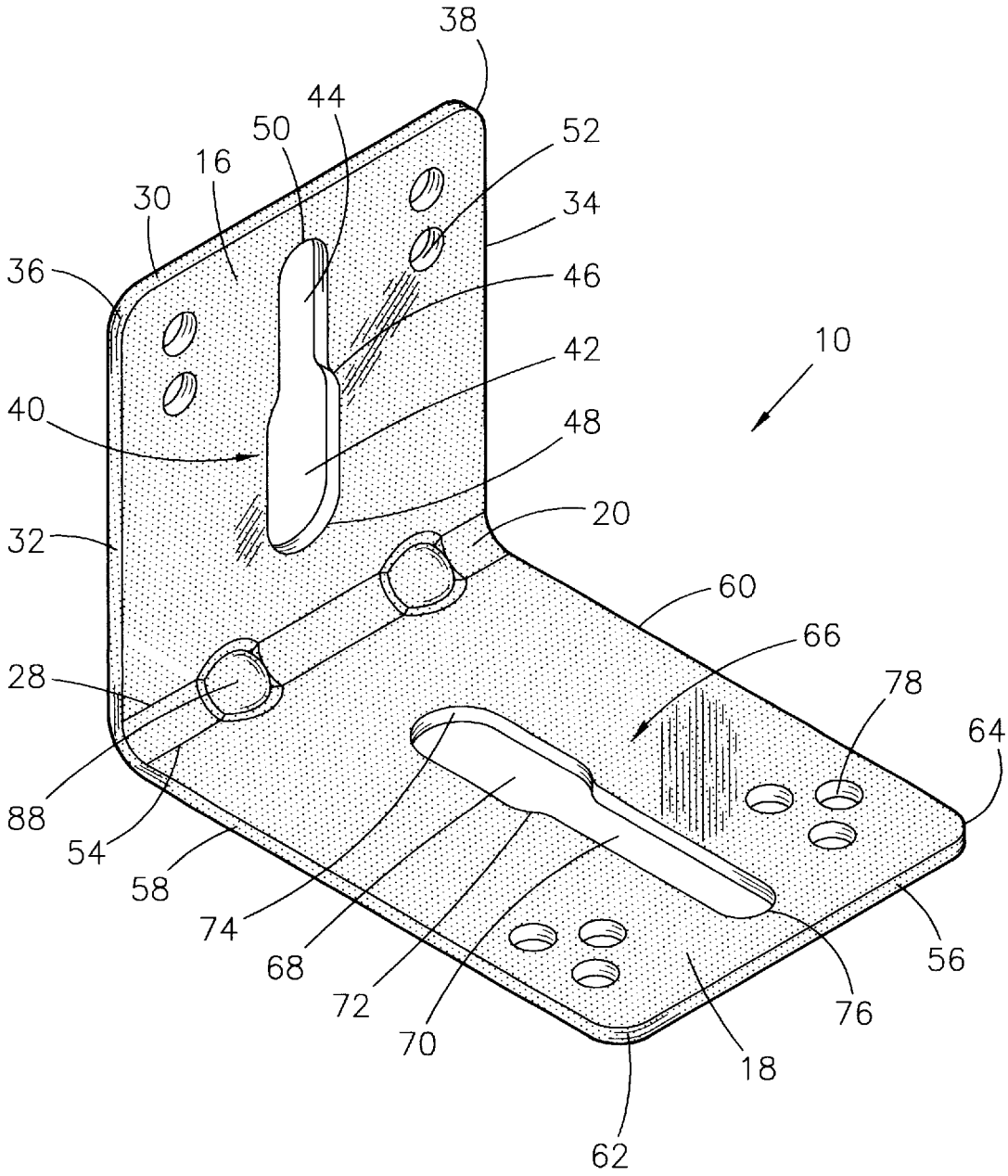
FIG. 2 is a perspective view of the reversible garage door track bracket shown unattached to a garage door track.

Referring to FIG. 1 and FIG. 2, a reversible garage door track bracket 10 is shown constructed in accordance with a preferred embodiment of the present invention. Several of the preferred brackets 10 are used to secure a garage door track 12 to a garage door frame or jamb 14 for mounting a conventional garage door over a garage door opening. Each bracket 10 broadly comprises a short flange 16, a long flange 18 oriented perpendicular to the short flange 16, and a bent portion 20 therebetween.

The bracket 10 is preferably constructed from a single piece of steel approximately one millimeter thick and approximately sixty millimeters wide. The short flange 16 is approximately sixty-six millimeters long. The short flange 16 includes a proximal edge 28 and a distal edge 30. The proximal edge 28 and the distal edge 30 are connected by a first side edge 32 and a second side edge 34. The corners 36,38 of the distal edge 30 are preferably rounded.

The short flange 16 also includes a short slot 40. The short slot 40 is approximately fifty millimeters long and substantially centered in the short flange 16 along its longitudinal axis. The short slot 40 includes a wide portion 42 for receiving the jamb bolt 24, a narrow portion 44 for receiving the track bolt 26, and a transition portion 46 therebetween. The wide portion 42 is approximately six millimeters wide and approximately twenty-four millimeters long. The wide portion 42 includes a curved end 48 which is approximately eight millimeters from the proximal edge 28. The narrow portion 44 is approximately four millimeters wide and approximately twenty-four millimeters long. The narrow portion 44 includes a curved end 50 which is approximately eight millimeters from the distal edge 30. The transition portion 46 transitions from the wide portion's 42 approximately six millimeter width to the narrow portion's 44 approximately four millimeter width along the transition portion's 46 approximately two millimeter length.

The short flange 16 further includes a plurality of holes 52 each for receiving one of the plurality of rivets 22 therethrough. Each hole 52 is circular and has a diameter of approximately three millimeters. The holes 52 are linearly aligned parallel to the short slot 40. Alternatively, the holes 52 can be staggered to provide maximum installation flexibility.

The long flange 18 is similar to the short flange 16, with the most significant difference being length. The long flange 18 is approximately eighty-five millimeters long. The long flange 18 includes a proximal edge 54 and a distal edge 56. The proximal edge 54 and the distal edge 56 are connected by a first side edge 58 and a second side edge 60. The corners 62,64 of the distal edge 56 are preferably rounded.

The long flange 18 also includes a long slot 66. The long slot 66 is similar to the short slot 40, with the most significant difference being length. The long slot 66 is approximately sixty millimeters long and substantially centered in the long flange 18 along its longitudinal axis. The long slot 66 includes a wide portion 68 for receiving the jamb bolt 24, a narrow portion 70 for receiving the track bolt 26, and a transition portion 72 therebetween. The wide portion 68 is approximately six millimeters wide and approximately twenty-nine millimeters long. The wide portion 68 includes curved end 74 which is approximately eight millimeters from the proximal edge 54. The narrow portion 70 is approximately four millimeters wide and approximately twenty-nine millimeters long. The narrow portion 70 includes a curved end 76 which is approximately seven millimeters from the distal edge 56. The transition portion 72 transitions from the wide portion's 68 approximately six millimeter width to the narrow portion's 70 approximately four millimeter width along the transition portion's 72 approximately two millimeter length.

The long flange 18 further includes a plurality of holes 78 each for receiving one of the plurality of rivets 22 therethrough. Each hole 78 is circular and has a diameter of approximately three millimeters. The holes 78 are staggered to provide maximum installation flexibility. Alternatively, the holes 78 can be linearly aligned parallel to the long slot 66.

The bent portion 20 connects the short flange 16 and the long flange 18 to form an approximately ninety degree angle therebetween. The bent portion 20 includes two ribs 88 which increase the structural integrity of the bracket 10.

Although the preferred embodiment has been described with the preferred dimensions, it is within the scope of the present invention for the short flange 16 to be between fifty and eighty millimeters long. Similarly, it is within the scope of the present invention for the long flange 18 to be between twenty and fifty millimeters longer than the short flange 16.

While the bracket 10 must be wide enough to provide sufficient structural stability, the bracket's 10 width is determined by convenience. It is anticipated that a convenient width is between thirty and one hundred millimeters.

The length of each slot 40,66 changes according to the length of the respective flange 16,18 such that each slot 40,66 is between ten and twenty millimeters shorter than its associated flange 16,18 in order to maintain structural stability of the bracket 10. It is anticipated that the wide portion 42 and the narrow portion 44 will have substantially the same length on a relatively short flange. On a relatively long flange, the narrow portion 70 will be substantially longer than the wide portion 68. This is because the jamb bolt 24 is typically secured close to the bent portion 20 in order to provide maximum structural stability. The jamb bolt 24 also does not usually require as much variation as does the track bolt 26.

As shown above each slot 40,66 serves to receive two differently sized bolts 24,26. It is important that each slot 40,66 is not significantly wider than a selected bolt in order to prevent the bracket 10 from sliding relative to the selected bolt. This is why each slot has both a wide portion 42,68 and a narrow portion 44,70 so as to accommodate bolts of various diameters. The jamb bolt is typically between five and ten millimeters in diameter. The track bolt 26 is typically between three and six millimeters in diameter. Therefore, the wide portions 42,68 have a width of between five and ten millimeters, while the narrow portions 44,70 have a width of between three and six millimeters.

Each hole 52,78 is designed to receive one of the plurality of rivets 22 therethrough. The diameter of a typical rivet used to secure the bracket 10 to the track 12 is between two and five millimeters. Therefore, each hole 52,78 has a preferred diameter of between two and five millimeters.

Figure 4:
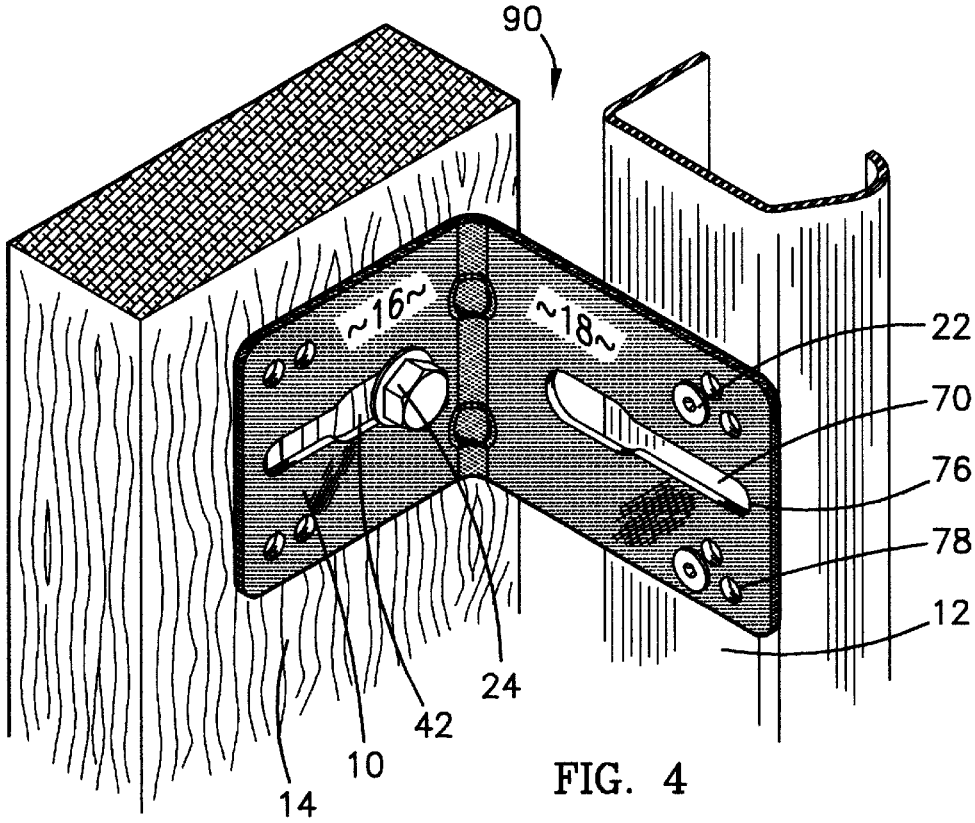
FIG. 4 is a perspective view of the reversible garage door track bracket showing its short flange secured to the jamb and its long flange secured to the track.
Figure 3:
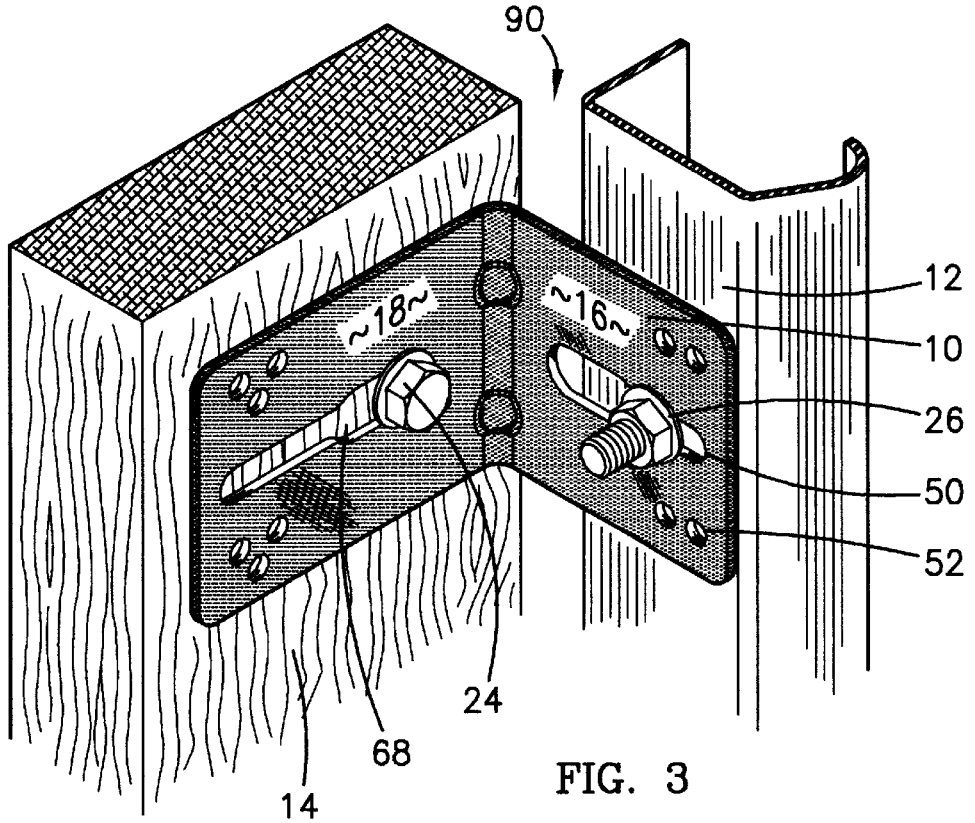
FIG. 3 is a perspective view of the reversible garage door track bracket showing its short flange secured to a track and its long flange secured to a jamb.

In use, as shown in FIG. 3 and FIG. 4, an installer has a choice to secure either the short flange 16 or the long flange 18 to the track 12. The installer chooses the flange 16,18, by examining the thickness of a garage door to be installed.

As shown in FIG. 3, if the installer is installing a relatively thin door, then the installer chooses to secure the short flange 16 to the track 12. The installer drives the track bolt 26 into the track 12 through the narrow portion 44 near the curved end 50. Alternatively, the installer can secure rivets 22 to the track 12 through the holes 52. In this manner, the installer secures as many brackets 10 to the track 12 as desired. Once all the brackets 10 are secured to the track 12, the installer positions the track 12 such that the long flange 18 of each bracket 10 is adjacent the jamb 14. The installer then drives the jamb bolt 24 into the jamb 14 through the wide portion 68. In this manner, the installer secures each bracket 10 to the jamb 14. The wide portion 68 allows the installer to vary the jamb bolt's 24 position in order to accommodate any variation in the jamb 14.

As shown in FIG. 4, if the installer is installing a relatively thick door, then the installer chooses to secure the long flange 18 to the track 12. The installer drives the track bolt 26 into the track 12 through the narrow portion 70 near the curved end 76. Alternatively, the installer can secure rivets 22 to the track 12 through the holes 78. In this manner, the installer secures as many brackets 10 to the track 12 as desired. Once all the brackets 10 are secured to the track 12, the installer positions the track 12 such that the short flange 16 of each bracket 10 is adjacent the jamb 14. The installer then drives the jamb bolt 24 into the jamb 14 through the wide portion 42. In this manner, the installer secures each bracket 10 to the jamb 14. The wide portion 42 allows the installer to vary the jamb bolt's 24 position in order to accommodate any variation in the jamb 14.

Once each jamb bolt 24 is secured as described, the installer can loosen each track bolt 26 and make adjustments in the track's 12 position. Each track bolt 26 is able to move within the narrow portions 44,70, accommodating such adjustments. Once the track's 12 position is finalized, the installer tightens each track bolt 26.

Further, if it is discovered that the installer desires a larger or smaller mounting distance 90, the installer can simply remove the two bolts 24,26, reverse the bracket 10, and reinstall the two bolts 24,26. This ability is extremely advantageous and allows a bracket 10 of one set of dimensions to accommodate a very large range of mounting distances 90.

Additionally, if the long flange 18 protrudes unnecessarily, the installer can reverse the bracket 10 as described above. This will avoid possible injury or damage caused by an undesirable protrusion.

Having thus described a preferred embodiment of the invention, what is claimed as new and desired to be protected by Letters Patent includes the following:

1. A reversible garage door track bracket, comprising:

a short flange including a plurality of rivet holes each for receiving a rivet therethrough;

a long flange including a plurality of rivet holes each for receiving a rivet therethrough;

a bent portion connecting the short and lone flanges, such that the flanges substantially define a right angle;

a first dual-width slot substantially centered within the short flange including a first narrow portion and a first elongated wide portion; and a second dual-width slot substantially centered within the long flange including a second narrow portion and a second elongated wide portion.

2. The reversible garage door track bracket as set forth in claim 1, each hole having a diameter of between two and five millimeters.

3. A reversible garage door track bracket comprising:

a short flange having a first length of between sixty and seventy millimeters, and including a plurality of rivet holes each for receiving a rivet therethrough;

a long flange having a second length of between eighty and ninety millimeters, and including a plurality of rivet holes each for receiving a rivet therethrough;

a bent portion connecting the short and long flanges, such that the flanges substantially define a right angle;

a short dual-width slot substantially centered within the short flange for receiving either a lamb bolt or a track bolt therethrough;

a long dual-width slot substantially centered within the long flange for receiving either a lamb bolt or a track bolt therethrough; and wherein each slot includes an elongated narrow portion and an elongated wide portion.

4. The reversible garage door track bracket as set forth in claim 3, each hole having a diameter of between two and five millimeters.

5. A reversible garage door track bracket comprising:

a short flange having length of between sixty and seventy millimeters;

a long flange having length of between eighty and ninety millimeters;

a bent portion connecting the short and long flanges, such that the flanges substantially define a right angle;

each flange including a plurality of rivet holes each between two and five millimeters in diameter for receiving a rivet therethrough;

a short dual-width slot being between ten and twenty millimeters shorter than and substantially centered within the short flange for receiving either a jamb bolt or a track bolt therethrough;

a long dual-width slot being between ten and twenty millimeters shorter than and substantially centered within the long flange for receiving either a jamb bolt or a track bolt therethrough; and each slot having a wide portion with a width of between six and eight millimeters and a narrow portion with a width of between three and five millimeters.

6. A method of mounting a garage door track to a jamb with a bracket to permit mounting of a garage door to the track, the method comprising the steps of:

inspecting the garage door to determine its thickness;

if the door is relatively thin, securing a short flange of the bracket to the track, and securing a long flange of the bracket to the jamb; and if the door is relatively thick, securing the long flange of the bracket to the track, and securing the short flange of the bracket to the jamb.

7. A reversible garage door track bracket comprising:

a short flange;

a long flange;

a bent portion connecting the short and long flanges, such that the flanges substantially define a right angle;

a first dual-width slot substantially centered within the short flange for receiving a bolt therethrough; and a dual-width slot substantially centered within the long flange for receiving a bolt therethrough, wherein each flange further includes a plurality of rivet holes each for receiving a rivet therethrough.

8. The reversible garage door track bracket as set forth in claim 7, each hole having a diameter of between two and five millimeters.

9. A reversible garage door track bracket comprising:

a short flange having a first length of between sixty and seventy millimeters;

a long flange having a second length of between eighty and ninety millimeters;

a bent portion connecting the short and long flanges, such that the flanges substantially define a right angle;

a short dual-width slot substantially centered within the short flange for receiving either a jamb bolt or a track bolt therethrough; and a long dual-width slot substantially centered within the long flange for receiving either a jamb bolt or a track bolt therethrough, wherein each flange further includes a plurality of rivet holes each for receiving a rivet therethrough.

10. The reversible garage door track bracket as set forth in claim 9, each hole having a diameter of between two and five millimeters.

* * * * *